US010604718B2

(12) United States Patent
Losch et al.

(10) Patent No.: US 10,604,718 B2
(45) Date of Patent: Mar. 31, 2020

(54) LUBRICANT COMPOSITION AND USE

(71) Applicant: Fuchs Petrolub SE, Mannheim (DE)

(72) Inventors: Achim Losch, Westhofen (DE); Agnes Fundus, Mannheim (DE)

(73) Assignee: Fuchs Petrolub SE, Mannheim (DE)

( * ) Notice: Subject to any disclaimer, the term of this patent is extended or adjusted under 35 U.S.C. 154(b) by 0 days.

(21) Appl. No.: 16/315,707

(22) PCT Filed: Jul. 12, 2017

(86) PCT No.: PCT/EP2017/000824
§ 371 (c)(1),
(2) Date: Jan. 7, 2019

(87) PCT Pub. No.: WO2018/010841
PCT Pub. Date: Jan. 18, 2018

(65) Prior Publication Data

US 2019/0300815 A1 Oct. 3, 2019

(30) Foreign Application Priority Data

Jul. 12, 2016 (EP) ..... 16001544

(51) Int. Cl.
*C10M 169/02* (2006.01)
*B08B 3/08* (2006.01)
(Continued)

(52) U.S. Cl.
CPC ..... *C10M 169/02* (2013.01); *B08B 3/08* (2013.01); *C10M 115/02* (2013.01); *C10M 117/02* (2013.01); *C10M 129/10* (2013.01); *C10M 129/70* (2013.01); *C10M 129/93* (2013.01); *C10M 133/04* (2013.01); *C10M 133/44* (2013.01); *C10M 135/10* (2013.01); *C10M 137/12* (2013.01); *C10M 141/10* (2013.01); *C10M 2203/003* (2013.01); *C10M 2203/102* (2013.01); *C10M 2203/1006* (2013.01);
(Continued)

(58) Field of Classification Search
CPC combination set(s) only.
See application file for complete search history.

(56) References Cited

U.S. PATENT DOCUMENTS

| | | | | |
|---|---|---|---|---|
| 5,021,172 | A | 6/1991 | Kavnatsky et al. | |
| 5,069,806 | A | 12/1991 | Trivett | |
| 2011/0034360 | A1* | 2/2011 | Hanefeld | C08F 297/08 508/591 |

FOREIGN PATENT DOCUMENTS

| | | |
|---|---|---|
| DE | 2 207 504 | 10/1972 |
| EP | 0 507 449 | 10/1992 |

* cited by examiner

*Primary Examiner* — Erin F Bergner
(74) *Attorney, Agent, or Firm* — Gudrun E. Huckett

(57) ABSTRACT

The present invention provides a lubricant composition which can be washed off cold and the use thereof for application to a metal strip as anti-corrosion, wash and/or forming lubricant. The composition is 50 to 90 wt % base fluid, 3 to 15 wt % sulfonate-based corrosion inhibitor, 1 to 20 wt % ester component, 0.5 to 3 wt % phosphorus source component or 1 to 10 wt % sulfur source component as high-pressure/anti-wear additive, 1 to 15 wt % emulsifier, 0.05 to 1 wt % carboxylic acid component, 0.05 to 1 wt % aminic and/or phenolic antioxidant, 0.5 to 5 wt % wax and/or thickener component, based in each case on the total weight of the composition. Further disclosed is a dry lubricant composition which can be washed off cold.

28 Claims, 3 Drawing Sheets

(51) Int. Cl.

| | |
|---|---|
| ***C10M 115/02*** | (2006.01) |
| ***C10M 117/02*** | (2006.01) |
| ***C10M 129/10*** | (2006.01) |
| ***C10M 129/70*** | (2006.01) |
| ***C10M 129/93*** | (2006.01) |
| ***C10M 133/04*** | (2006.01) |
| ***C10M 133/44*** | (2006.01) |
| ***C10M 135/10*** | (2006.01) |
| ***C10M 137/12*** | (2006.01) |
| ***C10M 141/10*** | (2006.01) |

(52) U.S. Cl.

CPC . *C10M 2203/1065* (2013.01); *C10M 2205/16* (2013.01); *C10M 2207/023* (2013.01); *C10M 2207/126* (2013.01); *C10M 2207/128* (2013.01); *C10M 2207/18* (2013.01); *C10M 2207/22* (2013.01); *C10M 2207/281* (2013.01); *C10M 2207/289* (2013.01); *C10M 2207/34* (2013.01); *C10M 2209/104* (2013.01); *C10M 2215/042* (2013.01); *C10M 2215/064* (2013.01); *C10M 2215/1013* (2013.01); *C10M 2215/223* (2013.01); *C10M 2215/26* (2013.01); *C10M 2215/30* (2013.01); *C10M 2219/044* (2013.01); *C10M 2219/046* (2013.01); *C10M 2223/04* (2013.01); *C10M 2223/049* (2013.01); *C10M 2223/06* (2013.01); *C10N 2220/022* (2013.01); *C10N 2220/023* (2013.01); *C10N 2220/142* (2013.01); *C10N 2230/02* (2013.01); *C10N 2230/06* (2013.01); *C10N 2230/10* (2013.01); *C10N 2230/12* (2013.01); *C10N 2240/402* (2013.01); *C10N 2240/407* (2013.01); *C10N 2240/408* (2013.01); *C10N 2250/08* (2013.01); *C10N 2260/02* (2013.01)

LUBRICANT COMPOSITION AND USE

BACKGROUND OF THE INVENTION

The invention concerns a lubricant composition that can be washed off cold and a dry lubricant composition as well as their use for application on a metal strip as corrosion protection, washing and/or forming lubricant.

Lubricants have various tasks in metal working. In the rolling mill, rolling oils or rolling emulsions are used which are applied on the metal strip in order to affect the friction conditions between roller and strip for an optimal rolling result. Rolling oils differ—depending on metal and tool—in the viscosity and in the presence and the concentration of additives for improving the lubricating action, polar and non-polar additives. Typical additives are extreme-pressure (EP) additives and anti-wear additives such as sulfur or phosphorus carriers as well as corrosion inhibitors, for example, sulfonates.

After rolling, in the steel mill (or aluminum plant) a corrosion protection agent is usually applied on the surface of the metal strips for preventing corrosion during storage and transport. In this way, the autoadhesion of metal strips that are stacked or wound to a coil (strip coil) is prevented also. Prior to working, for example, in a pressing or a stamping tool or in another metal working tool, this corrosion protection agent is removed by means of a washing oil or an alkaline cleaner and, for example, a drawing or stamping oil is applied that reduces the friction during forming of the metal strip and thereby facilitates working and ensures improved forming results or reduces the number of faulty formed products.

As corrosion protection agent for steel and aluminum strips or coils, mostly water-immiscible oils or wax-like products, so-called hot melts, are used which are also water-immiscible.

The washing, drawing, stamping or other forming oils used in the metal working plant can be, for example, aqueous emulsions or aqueous synthetic solutions or medium- to high-viscosity oil formulations.

It is important in all employed lubricants that they have a satisfactory compatibility with the entire process. Particularly in the automotive field, there are high requirements for keeping expenditure and number of steps following metal working as low as possible, with minimal rejects at the same time, for example, visible faults in the final coat due to lubricant residues. The surfaces of the produced pressed parts manufactured from the steel or aluminum strips are cleaned—optionally after assembly of pressed parts with conventional joining methods—prior to performing the subsequent treatment steps such as phosphatization, passivation, and electrophoretic dip coating. For cleaning, usually aqueous alkaline cleaners are employed which, in case of automotive bodies in white, preferably are comprised of a two-component system comprised of: a salt structure (builder) component and a surfactant component. The cleaning action is realized mostly by a spraying/dipping method at typical application temperatures of 50 to 60° C.

As an alternative to a pure corrosion protection agent, a so-called pre-lube can be applied in the steel mill or aluminum plant after rolling for final working of the rolled goods.

Pre-lubes are compositions that combine the properties of a corrosion protection oil with the lubricating action of a drawing oil. Like the corrosion protection agents, the pre-lubes prevent corrosion and adhesion during transport and storage of the metal strip coils but serve at the same time as drawing lubricant in the pressing plant. In case of pre-lubes, it is also very important, particularly in the automotive field, that an excellent compatibility exists with every individual process from cold strip to the body in white. When the pre-lube is compatible with every process step (in particular, welding, gluing etc.) including painting in the production chain, a significant reduction of the number and quantity of the lubricants employed in the pressing plant (washing oils, drawing, stamping or other forming oils) as well as of the working steps to be performed is enabled.

DE 2 207 504 A discloses an emulsifiable lubricant or slip agent for cold forming of metals that can be mixed with water for forming a desired lubricant emulsion. The lubricant is comprised of 20 to 60 wt % oil, 20 to 59 wt % solid aliphatic mono carboxylic acids with 10 to 30 carbon atoms, 1 to 15 wt % alkanol amine with 2 to 5 carbon atoms, to 15 wt % emulsifier, 0.05 to 2 wt % aromatic sulfonate, and 2 to 15 wt % monoalky or dialkyl phosphate with 8 to 20 carbon atoms in the alkyl group, and optionally 1 to 5 wt % liquid fatty acid with 12 to 22 carbon atoms in combination with 4 to 8 wt % aliphatic fatty acid amide with 10 to 18 carbon atoms. For producing the emulsion with water, a temperature of more than 60° C., preferably between 80 to 90° C., is required.

Due to the reduced corrosion protection, aqueous lubricant emulsions are however not suitable likewise as pre-lube for steel and aluminum.

A dry pre-lube lubricant (hot melt) that is said to be washed off "cold" is disclosed in U.S. Pat. No. 5,069,806. This lubricant, applied in melted form on the steel strip so that a flexible solid lubricant film is obtained after cooling, can be washed off by an alkaline solution at a temperature of 49 to 60° C. (120 to 140° F.). It is based on 80 to 90 wt % of a substantially saturated refined ester which is formed of an aliphatic, polyhydric alcohol and a $C_2$-$C_6$ carboxylic acid. Preferably, this is a hydrogenated tallow triglyceride lubricant base. Further components are 4 to 14 wt % partially esterified plant oil (castor oil) as a softener and 2 to 6 wt % surfactant that can be an aromatic polyether (reaction product of an aromatic $C_{14}$-$C_{20}$ alcohol with 5 to 15 mol ethylene oxide and 10 to 20 mol propylene oxide per mol alcohol), stearamide alkanol amide, iso-stearamide alkanol amide, a mixture of an aspartic acid diester and oleic acid, imidazolins or mixtures thereof. As a film reinforcer, 0.1 to 2 wt % of an ethylene-carboxylic acid-copolymer is employed; optionally, the lubricant can also contain additionally as a corrosion inhibitor 0.1 to 3 wt % of an antioxidant, preferably of the hindered phenolic type.

Based on this prior art, it is object of the present invention to provide an improved lubricant composition that can be washed off cold for application on a metal strip that can be used as pre-lube or corrosion protection, forming and/or washing oil. Washing off cold is to be understood here as removal of the lubricant with an aqueous alkaline cleaner, for example, in a cleaning bath, at room temperature or without additional heating of the cleaning bath, i.e., significantly below the usual temperatures of 49 to 60° C. in the prior art.

At the same time, the lubricant composition should exhibit protection from corrosion and from adhesion of the metal strips, satisfactory lubrication action for forming processes as well as compatibility with all downstream manufacturing steps. Moreover, the lubricant composition should form a stable and homogenous film after application on the metal strips, be inexpensive in manufacture and disposal, be simple in regard to handling, and suitable for various steel and aluminum qualities.

SUMMARY OF THE INVENTION

This object is solved by a lubricant composition characterized in that the composition comprises 50 to 90 wt % base fluid,
3 to 15 wt % sulfonate-based corrosion inhibitor,
1 to 20 wt % ester component,
0.5 to 3 wt % phosphorus carrier component or 1 to 10 wt % sulfur carrier component as extreme-pressure/anti-wear additive,
1 to 15 wt % emulsifier,
0.05 to 1 wt % carboxylic acid component,
0.05 to 1 wt % aminic and/or phenolic antioxidant,
0.5 to 5 wt % wax and/or thickener component,
in each case relative to the total weight of the composition.

Further embodiments are disclosed in the dependent claims.

Moreover, this object is solved by a dry lubricant composition characterized in that the composition comprises 10 to 90 wt % wax component,
3 to 15 wt % sulfonate-based corrosion inhibitor,
0.05 to 1.7 wt % of at least one further inhibitor component,
0.5 to 3 wt % phosphorus carrier component or 1 to 10 wt % sulfur carrier component as extreme-pressure/anti-wear additive,
to 15 wt % emulsifier,
0.05 to 1 wt % carboxylic acid component,
0.05 to 1 wt % aminic and/or phenolic antioxidant,
in each case relative to the total weight of the composition.

The object of providing an improved use of a lubricant composition for application on a metal strip as a corrosion protection, washing and/or forming lubricant is solved by using a lubricant composition according to the invention as set forth above for application on a metal strip as corrosion protection, washing and/or forming lubricant, wherein the composition can be washed off cold with an alkaline aqueous cleaner.

The lubricant composition according to the invention in a first embodiment is provided for application on a metal strip, such as a steel or aluminum strip, as corrosion protection, washing and/or forming lubricant. Advantageously, the lubricant composition according to the invention can be washed off cold so that devices as well as energy and costs for heating of cleaning baths in the pretreatment of formed sheet metal parts can be saved.

A lubricant composition according to the invention that can be washed off cold for application on a metal strip as a corrosion protection, washing and/or forming lubricant comprises 50 to 90 wt % base fluid,
3 to 15 wt % sulfonate-based corrosion inhibitor,
1 to 20 wt % ester component,
0.5 to 3 wt % phosphorus carrier component or 1 to 10 wt % sulfur carrier component as extreme-pressure/anti-wear additive,
1 to 15 wt % emulsifier,
0.05 to 1 wt % carboxylic acid component,
0.05 to 1 wt % aminic and/or phenolic antioxidant,
0.5 to 5 wt % wax and/or thickener component,
in each case relative to the total weight of the composition.

In contrast to what has been conventional up to now, a lubricant with this composition can indeed be washed off cold, i.e., at temperatures significantly below 50° C., in particular at room temperature with an aqueous alkaline cleaning solution.

Preferably, the proportion of the base fluid in the lubricant composition can amount to 55 to 80 wt % and particularly preferred 60 to 70 wt % relative to the total weight of the composition. Depending on the intended application of the lubricant composition as washing lubricating agent, as rolling mill-applied corrosion protection lubricant or pre-lube or as a forming lubricant, different viscosities are provided which are adjusted by selection and/or composition of the base fluid. Therefore, in order to adjust a desired viscosity, a mixture of at least two base oils differing with regard to their kinematic viscosity at 40° C., which are primarily selected from base oils of the group I and group with a kinematic viscosity at 40° C. of 3 to 700 $mm^2/s$, can be employed also as a base fluid. However, group III and IV base oils are not excluded. By selecting the base oils, which are different with regard to their viscosity, and their weight ratio relative to each other, the kinematic viscosity at 40° C. of the composition can be adjusted as needed in a range of 5 to 300 $mm^2/s$.

The lubricant composition according to the invention can be used as a pre-lube lubricant that combines corrosion protection function with capability of being emulsified and lubricating action in working processes. As a corrosion protection lubricant, the composition according to the invention is applied in the rolling mill in order to protect the metal strip during the storage and the transport from autoadhesion and corrosion. Optionally, in the further working plant, for example, pressing plant, it may be required to apply, at least in spots, an additional lubricant for forming. This forming or drawing oil lubricant can also comprise a composition according to the invention with adjusted viscosity. Also, an optionally required washing oil can be a composition according to the invention with modified viscosity. For washing lubricants, a kinematic viscosity at 40° C. in the range of 5 to 25 $mm^2/s$, preferably 8 to 15 $mm^2/s$; for rolling mill-applied corrosion protection agents or pre-lubes 20 to 120 $mm^2/s$, preferably 60 to 100 $mm^2/s$; and for forming lubricants 60 to 300 $mm^2/s$, preferably 130 to 200 $mm^2/s$, can be adjusted.

For use as pre-lube, for example, the base fluid of a particularly preferred lubricant composition can comprise a first base oil with a kinematic viscosity at 40° C. of 700 $mm^2/s$ and a second base oil with a kinematic viscosity at 40° C. of 40 $mm^2/s$. In order to achieve a kinematic viscosity at 40° C. of 100±10 $mm^2/s$, a weight ratio of the first base oil to the second base oil in the base fluid of between 3:1 to 4:1 is adjusted.

The sulfonate-based corrosion inhibitor of the lubricant composition is selected from the group that contains overbased and neutral Ca sulfonates, overbased and neutral Na sulfonates and mixtures thereof wherein a composition according to the invention contains at least one overbased sulfonate. Preferably, the composition can contain 0.5 to 5 wt % overbased Na sulfonate and/or 2 to 10 wt % overbased Ca sulfonate. Optionally, a composition according to the invention can comprise, in addition to the at least one overbased sulfonate, 1 to 5 wt % neutral Ca sulfonate and/or 1 to 5 wt % neutral Na sulfonate, in each case under the condition that the weight proportions of the overbased and optionally neutral sulfonates in sum result in 3 to 15 wt % sulfonate-based corrosion inhibitors relative to the total weight of the composition.

A preferred sulfonate concept for a lubricant composition according to the invention comprises 1 to 5 wt % overbased Na sulfonate and 3 to 5 wt % overbased Ca sulfonate. Particularly preferred, the composition can comprise 1.5 wt % overbased sodium sulfonate and 3.5 wt % overbased calcium sulfonate as corrosion inhibitors.

An alternative sulfonate concept provides, in addition to 1 to 5 wt % overbased Na sulfonate and 3 to 5 wt % of overbased Ca sulfonate, 1 to 5 wt % neutral Ca sulfonate. Preferably, this sulfonate concept comprises 1.5 wt % overbased Na sulfonate and 3.5 wt % overbased Ca sulfonate and 3 wt % of neutral Ca sulfonate.

Further alternative compositions comprise only overbased Na sulfonate with 3 to 6 wt %, preferably 4.6 wt %, or only overbased Ca sulfonate with 3 to 10 wt %, preferably 5.2 wt %.

The specified weight proportions relate in each case to the total weight of the composition.

Moreover, a lubricant composition according to the invention can comprise in addition 0.05 to 1.7 wt % of at least one further inhibitor component relative to the total weight of the composition. The further inhibitor component in the composition can be selected from 0.05 to 0.2 wt % triazoles, preferably 0.1 wt % benzotriazole or water-soluble benzotriazole derivatives, and/or 0.1-1.5 wt % amines, preferably trialkanolamines such as triethanolamine.

The ester component of a lubricant composition can be 10 to 20 wt % fatty acid ester or to 5 wt % wool fat ester, relative to the total weight of the composition, respectively. Preferably, a composition according to the invention can comprise 15 wt % fatty acid ester relative to the total weight of the composition.

Preferred lubricant compositions comprise as extreme-pressure/anti-wear additive a phosphorus component whose proportion amounts to in particular 2 wt % relative to the total weight of the composition. The phosphorus carrier component can be a dialkyl hydrogenphosphite wherein each alkyl residue is saturated or unsaturated and comprises 14 to 22 C atoms, for example, dioleyl hydrogenphosphite.

The emulsifier that ensures improved cleaning-off action with an aqueous cleaner can be selected from non-ionic surfactants, in particular fatty alcohol alkoxylates. Preferred fatty alcohol ethoxylates are based on fatty alcohols with 16 to 18 C atoms and comprise a degree of alkoxylation or degree of ethoxylation of 2 to 5 moles. Also, mixtures of different non-ionic surfactants or fatty alcohol alkoxylates can be used which are different in regard to e.g. the degree of alkoxylation. Also, propoxylated or mixed ethoxylated and propoxylated fatty alcohols can be employed as emulsifiers.

As alternative or additional emulsifiers, anionic surfactants, for example, alkyl ether carboxylic acids or phosphoric acid esters can be employed. Among the alkyl ether carboxylic acids, $C_{14-22}$ fatty alcohol polyglycol ether carboxylic acids are preferred which may be saturated or unsaturated. As phosphoric acid esters, alkoxylated fatty alcohol phosphate esters, preferably phosphate esters of saturated or unsaturated fatty alcohols with 16 to 18 C atoms and a degree of ethoxylation of, for example, 5 moles are conceivable. But here also phosphate esters of fatty alcohols with a deviating degree of ethoxylation or propoxylated or mixed propoxylated and ethoxylated fatty alcohols are conceivable.

The proportion of each emulsifier component alone or in the mixture amounts to respectively 1 to 5 wt % relative to the total weight of the composition, under the condition that the total content of emulsifier does not surpass 15 wt %.

A preferred composition according to the invention comprises 7.5 wt % of fatty alcohol alkoxylate mixture as emulsifier, relative to the total weight of the composition, wherein the fatty alcohol alkoxylate mixture is in particular comprised of 5 wt % $C_{16-18}$ fatty alcohol with a degree of ethoxylation of 5 moles and 2.5 wt % of $C_{16-18}$ fatty alcohol with a degree of ethoxylation of 2 moles.

The carboxylic acid component of a lubricant composition can be comprised of saturated or unsaturated carboxylic acids with 16 to 22 C atoms, for example, tall oil fatty acids, oleic acid, and behenic acid, or dimer acids that are dicarboxylic acids produced by dimerization of unsaturated fatty acids from tall oil. Mixtures thereof are also conceivable. A preferred composition can comprise 0.5 wt % tall oil fatty acid relative to the total weight of the composition. Preferred are tall oil fatty acids with a high fatty acid content and a low content of resin acids.

The aminic antioxidant that is contained in the lubricant composition according to the invention can be a reaction product of N-phenyl benzenamine with 2,4,4-trimethyl pentene (Irganox® L57). The phenolic antioxidant can be, for example, selected from octyl-3,5-di-tert-butyl-4-hydroxyhydrocinnamate (Irganox® L135), octadecyl-3-(3,5-di-tert-butyl-4-hydroxyphenyl)propionate (IRGANOX® L107). A preferred composition can comprise 0.25 wt % aminic antioxidant and 0.25 wt % phenolic antioxidant, preferably octyl-3,5-di-tert-butyl-4-hydroxyhydrocinnamate, relative to the total weight of the composition.

The wax and/or thickener component of a lubricant composition according to the invention can be selected from

- paraffinic waxes,
- castor oil derivatives, in particular thixotropic thickeners based on hydrogenated castor oil,
- fatty acid derivatives, in particular fatty acid esters or fatty acid amides of C16-20 saturated and unsaturated fatty acids, for example, methyl 12-hydroxystearate, octadecyl stearates, or refined oleic acid amide,
- polymers, for example, block polymers, in particular linear tri-block copolymers based on styrene and ethylene/butylene with PS-PE/PB-PS and 30% PS, polymethacrylates in mineral oil, and low molecular polyisobutanes (Pib 1300).

A preferred composition can comprise 3 wt % paraffinic wax with solidification point at 64 to 66° C. as wax and/or thickener component.

A further composition according to the invention concerns a dry lubricant, also referred to as hot melt, wherein waxes are used instead of a base fluid. The hot melt composition is heated as a corrosion protection lubricant or pre-lube for application on a metal strip and can optionally also be used as an aqueous dispersion but can still be cleaned off cold in the composition according to the invention. The dry lubricant composition that can be washed off cold comprises:

10 to 90 wt % wax component,
3 to 15 wt % sulfonate-based corrosion inhibitor,
0.05 to 1.7 wt % of at least one further inhibitor component,
0.5 to 3 wt % phosphorus carrier component or 1 to 10 wt % sulfur carrier component as extreme-pressure/anti-wear additive,
0 to 15 wt % emulsifier,
0.05 to 1 wt % carboxylic acid component,
0.05 to 1 wt % aminic and/or phenolic antioxidant,
in each case relative to the total weight of the composition.

Depending on the proportion of the wax component, the addition of a base fluid may be optionally required as a supplement to 100 wt % of the composition.

The wax component is selected from one or several organic components that have a melting range of 35 to 75° C., preferably 40 to 70° C., and can be or can comprise a polyalkylene glycol, polyalkylene glycol ester, an ester, ester ethoxylate, a carboxylic acid ethoxylate or an ether carboxylic acid or its alkaline and alkaline earth soaps, glycerin fatty acid ester, a polyol ester or sorbitol ester or their ethoxylates, an alcohol or fatty alcohol or their ethoxylates.

Examples are polyethylene glycols 1500, 2000, and 4000, polyalkylene glycol ester, sorbitan tristearate, sorbitan tristearate ethoxylate, sorbitan monostearate, sorbitan monostearate ethoxylate, stearyl alcohol, stearyl cetyl alcohol, 12-hydroxystearic acid, methyl 12-hydroxystearate, glycerol monostearate, glycerol monolaureate, PEG1500 monostearate, pentaerythritol tetrastearate.

Also, combinations of the aforementioned wax components are conceivable, e.g. sorbitan tristearate, and sorbitan tristearate ethoxylate (e.g. in the ratio 40:60) or sorbitan monostearate and sorbitan monostearate ethoxylate (e.g., in the ratio 75:25). However, other combinations of the aforementioned wax components are conceivable also.

In case of solid wax components or thickeners that themselves have an emulsifying action (e.g., the aforementioned sorbitan ethoxylates), optionally the addition of the liquid emulsifiers can be omitted.

An embodiment of the dry lubricant composition can provide that as a wax component a mixture of 7.5 wt % sorbitan tristearate and 7.5 wt % of sorbitan tristearate ethoxylate (20 EO) is used and the remaining components are contained as indicated above, i.e., the emulsifier may be omitted; here, a base oil is added for supplementing to 100 wt % of the composition.

The wax component can moreover be selected, as in the above lubricant composition according to the invention, from

- paraffinic waxes,
- castor oil derivatives, in particular thixotropic thickeners based on hydrogenated castor oil,
- fatty acid derivatives, in particular fatty acid esters or fatty acid amides of C16-20 saturated and unsaturated fatty acids, for example, methyl 12-hydroxystearate, octadecyl stearates, or refined oleic acid amide.

Different wax components can also be mixed in order to impart the desired properties to the dry lubricant composition.

In further embodiments of the dry lubricant composition, the further components can be embodied in accordance with the above specifications to the lubricant composition according to the invention.

In the present application, the lubricant compositions according to the invention are described as corrosion protection, washing and/or forming lubricants and dry lubricant compositions as corrosion protection lubricant or pre-lube. Lubricant compositions according to the invention embodied as corrosion protection agent or pre-lube as well as dry lubricant compositions are applied in the rolling mill, washing and forming lubricants in the pressing plant. Corrosion protection agents or pre-lubes, washing and forming lubricants are to be understood as including all synonymously employed terms that relate to such lubricants. Corrosion protection agents can be, for example, also referred to as corrosion protection oil etc. and pre-lubes, for example, as corrosion protection oil with forming properties etc. Dry lubricant agents are also referred to by the terms of hot melt, hot melt dry lube, dry lube, or dry lubricant. Washing lubricants are, for example, also referred to as washing oils or oily washing fluid, and forming lubricant also means drawing oil, forming lubricant, drawing lubricant, additional lubricant etc.

A use according to the invention of the lubricant composition, also according to the invention, concerns their application on a metal strip as corrosion protection, washing and/or forming lubricant. The lubricant composition allows for cold washing off with an alkaline aqueous cleaner. Since the emulsifier contained in the lubricant composition according to the invention during cleaning of the metal strip is introduced into the alkaline aqueous cleaner, the surfactant component of the latter therefore must be refurbished in reduced quantity; i.e., the surfactant concentration of the alkaline aqueous cleaner is adjusted to the emulsifier content of the lubricant composition.

BRIEF DESCRIPTION OF THE DRAWINGS

Further embodiments as well as some of the advantages that are associated with these and further embodiments will become clear and better understood based on the following detailed description with reference to the Figures. It is shown in.

DESCRIPTION OF PREFERRED EMBODIMENTS

Figure 1:
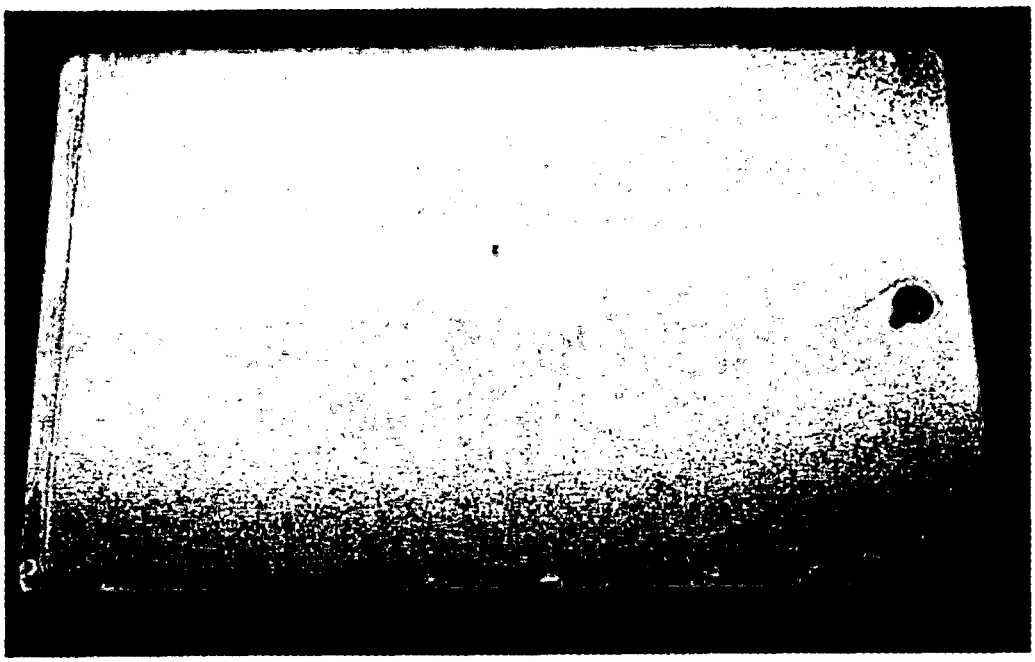
FIG. 1 a photographic representation of a test sheet that has been coated with a lubricant composition according to the invention, after completion of cleaning at 25° C.
Figure 2:
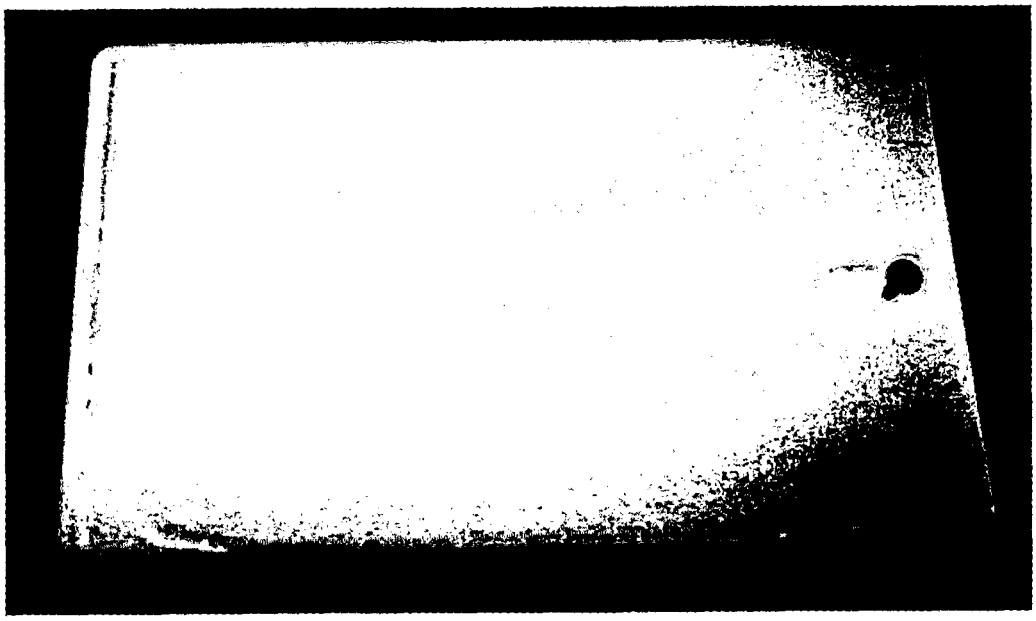
FIG. 2 a photographic representation of a test sheet that has been coated with an alternative lubricant composition according to the invention, after completion of cleaning at 25° C.
Figure 3:
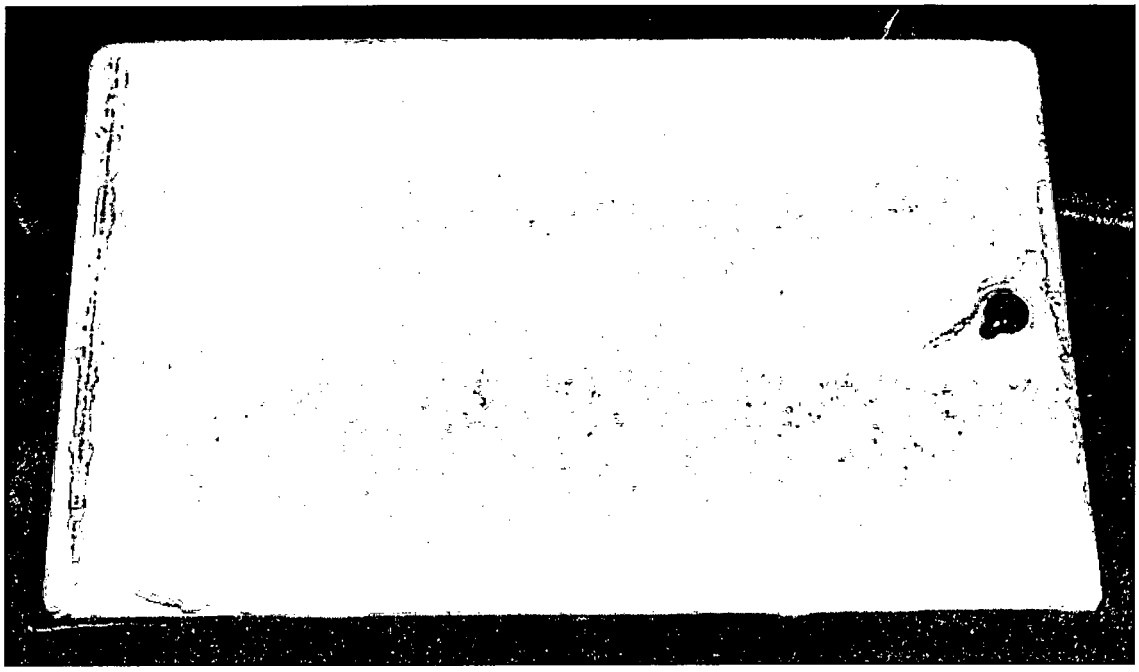
FIG. 3 a photographic representation of a test sheet that has been coated with a further alternative lubricant composition according to the invention, after completion of cleaning at 25° C.
Figure 4:
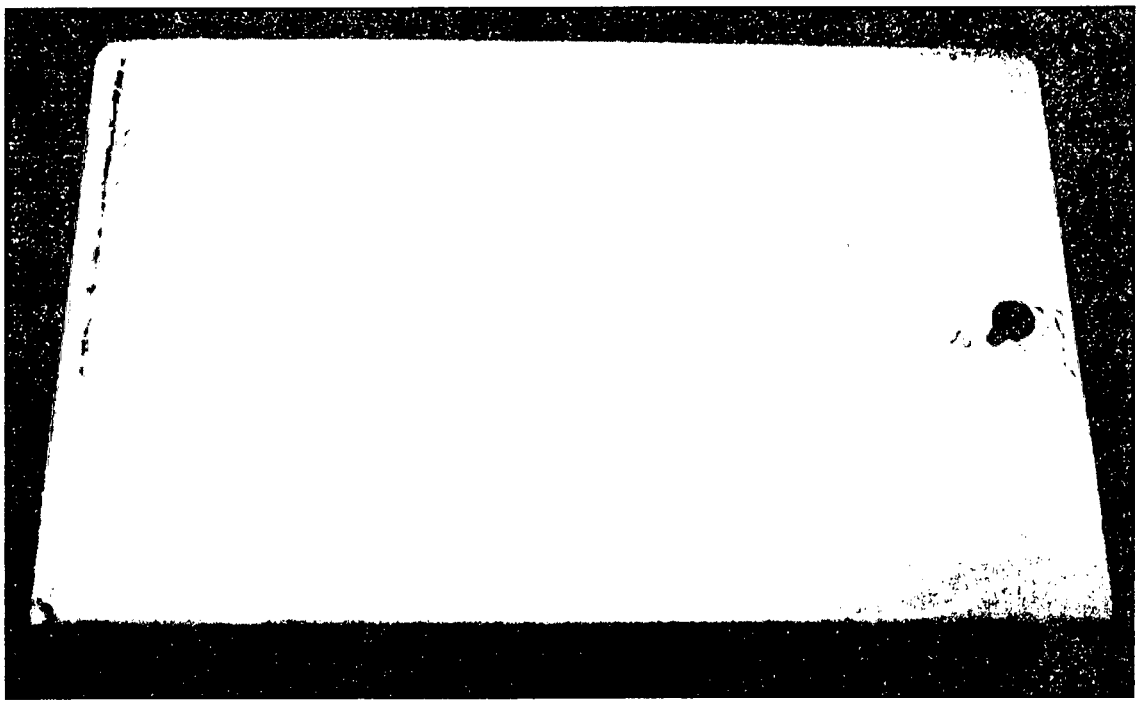
FIG. 4 a photographic representation of a test sheet that has been coated with yet another alternative lubricant composition according to the invention, after completion of cleaning at 25° C.

The lubricant composition according to the invention relates to a product range of corrosion protection oils and forming lubricants as well as washing oils, primarily in the automotive body-in-white process. The latter begins with the application of the corrosion protection oil or pre-lube on the metal sheet in the steel mill or aluminum plant and ends with application of the base coat by means of cathodic dip coating (CDC). Depending on the target product, pre-lube or corrosion protection oil, washing oil, and drawing oil are used in this context. Prior to CDC, all oils are removed by an alkaline aqueous cleaner system for which purpose up to now a temperature of approximately 55° C. is required.

When lubricant compositions according to the invention are used as pre-lube or corrosion protection oil, washing oil, and drawing oil, they can be removed completely even at low cleaning temperatures from the metal sheet (example: automotive body in white) so that costs and energy due to heating of the cleaner baths are saved.

The emulsifiers that are used in the lubricant composition according to the invention as cleaning-active components do not interfere in this context with the main properties of the oils—depending on the product type these are corrosion protection, lubricating and/or washing action—in particular when using non-ionic surfactants. Moreover, the employed emulsifiers fulfill the demands in regard to compatibility with the subsequent processing steps (inter alia gluing of the body in white; welding; cathodic dip coating).

Furthermore, the lubricant composition according to the invention fulfills the requirements with regard to application capability in steel mills or aluminum plants. A common application type is electrostatic spraying; but also other application work, for example, conventional spraying can be employed. Compositions that are suitable for this exhibit a kinematic viscosity at 40° C. in the range of 20 to 120 $mm^2/s$. For spraying, a light heating to 50 to 60° C. for complete dissolving of the contained wax/thickener may be required. For other application forms, for example, by means of roll coater or similar coating devices or when the composition is designed as a washing or forming or drawing oil, the composition can also be adjusted in a different viscosity range and heating is not required for application. Optionally, a lubricant composition according to the invention can also be applied as an aqueous dispersion. Usually, the application of forming oils is done by spraying or less frequently by roll coater. On the other hand, felt, squeezing and/or rubber rolls are employed for application of washing oils.

With a suitably adjusted viscosity, the composition according to the invention can be applied as a uniform thin layer on the metal strip as a corrosion lubricant or pre-lube layer formed of different compositions is preferably in the range of 1 to 5 μm, particularly preferred amounts to approximately 2 μm. Accordingly, the composition according to the invention not only provides corrosion protection for steel as well as aluminum during storage and transport but also acts as a lubricant during forming. The joining methods such as welding, gluing, crimping or clinching following the forming action can be performed without cleaning, i.e., with adhering lubricant composition that is thus compatible with most or all well-established body-in-white adhesives, such as high-strength construction adhesives or sealing adhesives.

Prior to phosphatization and painting, the lubricant composition is removed by means of an alkaline aqueous cleaner in a dip/spray bath. Complete removal is important in order to avoid flaws in the paint coat due to lubricant residues.

Due to the lubricant composition removed from the sheet metal parts to be cleaned the emulsifiers contained in the lubricant composition are transferred into the cleaning bath and increase thus the concentration of surfactants or emulsifiers therein because the cleaning baths are recycled and recirculated. Since an increase of these components without a corresponding consideration in the cleaning process would lead to disruptions, the emulsifier quantity that is introduced by the corrosion protection and processing oils must be taken into account when dosing the cleaning baths in that the surfactant component must be correspondingly refurbished in lesser amounts.

Table 1 shows a particularly preferred lubricant composition that comprises a kinematic viscosity at 40° C. of 100 $mm^2/s$.

| wt % | component | example |
|---|---|---|
| 66.4 | base fluid | |
| 52.2 | group I base oil, kin. viscosity (40° C.) = 700 $mm^2/s$ | PIONIER ® 4529 (H & R KG, Hamburg, DE) |
| 14.2 | group II base oil, kin. viscosity (40° C.) = 40 $mm^2/s$ | Chevron Neutral Oil 220 R (Chevron, Gent, Belgium) |
| 5 | sulfonate component | |
| 1.5 | overbased Na sulfonate | Lubrizol ® 5318A (Lubrizol Company, Wickliffe, Ohio, USA) |
| 3.5 | overbased Ca sulfonate | Calcinate ™ OR (Chemtura Corp. Petroleum Additives, Middlebury, CT, USA) |
| 0.1 | inhibitor component | benzotriazole |
| 15 | ester component saturated fatty acid ester, 2-ethylhexyl palmitate | Metalest-EHP 99 (FACI Metalest, Zaragoza, Spain)/Radia 7780 (Oleon GmbH, Wiesbaden, DE) |
| 2 | phosphorus carrier component dioleyl hydrogenphosphite | Doverphos ® 253 (Dover Chemical Corp., Dover, Ohio, USA) |
| 7.5 | emulsifier | |
| 5 | non-ionic surfactant, fatty alcohol ethoxylate, 5 moles | Emulsogen M (Clariant, Muttenz, Switzerland) Rhodasurf CET 5 (Rhodia Novecare, Courbevoie, France) |
| 2.5 | non-ionic surfactant, fatty alcohol ethoxylate, 2 moles | Rhodasurf CET 2 (Rhodia Novecare, Courbevoie, France) |
| 0.5 | carboxylic acid component | Tall oil fatty acid for2 (Forchem Oy, Rauma, Finland) |
| 0.25 | aminic antioxidant | Irganox L57 (Ciba Spezialitätenchemie, Basel, Switzerland) |
| 0.25 | phenolic antioxidant | Irganox L135 (Ciba Spezialitätenchemie, Basel, Schweiz) |
| 3 | wax component paraffinic waxes, solidification point 64-66° C. | HR 64-66 (H & R KG, Hamburg, DE) |

in the range of 0.5 to 2.5 μm, preferably approximately 1 μm; as forming lubricant in the range of 1 to 10 μm, preferably approximately 2 μm; and as washing lubricant in the range of 1 to 5 μm, preferably 0.5 to 1 μm, and does not run off due to the contained waxes/thickeners. A total thickness of the Alternative compositions vary primarily with regard to the sulfonate concept that is used as a corrosion inhibitor. To a lesser degree, also the base oil mixture that forms the base fluid can vary in order to adjust the viscosity in the desired range.

While the first particularly preferred lubricant composition comprises only overbased Na and Ca sulfonates, in an alternative composition overbased and neutral sulfonates can be contained:

Table 2 shows base fluid and sulfonate component of an alternative lubricant composition, the further components correspond to Table 1.

| wt % | component | example |
|---|---|---|
| 63.4 | base fluid | |
| 49.2 | group I base oil, kin. viscosity (40° C.) = 700 $mm^2/s$ | PIONIER ® 4529 (H & R KG, Hamburg, DE) |
| 14.2 | group II base oil, kin. viscosity (40° C.) = 40 $mm^2/s$ | Chevron Neutral Oil 220 R (Chevron, Gent, Belgium) |
| 8 | sulfonate component | |
| 1.5 | overbased Na sulfonate | Lubrizol ® 5318A (Lubrizol Co, Wickliffe, Ohio, USA) |
| 3.5 | overbased Ca sulfonate | Calcinate ™ OR (Chemtura Corp. Petroleum Additives, Middlebury, CT, USA) |
| 3 | neutral Ca sulfonate | Arcot 626F (PCAS, Longjumeau, France) |

Tables 3 and 4 show further alternative compositions that each contain only overbased Na sulfonate or only overbased Ca sulfonate. Here, the other components correspond also to those in Table 1.

TABLE 3

| wt % | component | example |
|---|---|---|
| 66.8 | base fluid | |
| 52.6 | group I base oil, kin. viscosity (40° C.) = 700 $mm^2/s$ | PIONIER ® 4529 (H & R KG, Hamburg, DE) |
| 14.2 | group II base oil, kin. viscosity (40° C.) = 40 $mm^2/s$ | Chevron Neutral Oil 220 R (Chevron, 9052 Gent, Belgium) |
| 4.6 | overbased Na sulfonate | Lubrizol ® 5318A (Lubrizol Co, Wickliffe, Ohio, USA) |

TABLE 4

| wt % | component | example |
|---|---|---|
| 66.2 | base fluid | |
| 52 | group I base oil, kin. viscosity (40° C.) = 700 $mm^2/s$ | PIONIER ® 4529 (H & R KG, Hamburg, DE) |
| 14.2 | group II base oil, kin. viscosity (40° C.) = 40 $mm^2/s$ | Chevron Neutral Oil 220 R (Chevron, Gent, Belgium) |
| 5.2 | overbased Ca sulfonate | Calcinate ™ OR (Chemtura Corp. Petroleum Additives, Middlebury, CT, USA) |

It is emphasized that the composition according to the invention is not to be limited to the particularly preferred compositions which are provided as examples.

It is obvious to a person of skill in the art that the composition can be changed within the claim ranges in order to modify certain properties of the composition. Also, alternatives the aforementioned components and examples within the claimed scope are readily conceivable.

For example, instead of the two base oils which are listed in Tables 1 to 4, which form the base fluid, also other group I and group II oils are conceivable which may have deviating kinematic viscosities—in particular when the kinematic viscosity (40° C.) of the composition is to be adjusted in deviation from the above 100 $mm^2/s$ within the claimed range of 8 to 200 $mm^2/s$.

Table 5 discloses further base oils which may be used in a composition according to the invention for forming the base fluid with the desired viscosity:

| base oil | kinematic viscosity (40° C.) | example |
|---|---|---|
| naphthenic | kV40 = 7.6 $mm^2/s$ | NS 8 (Nynas, Stockholm, Sweden) |
| naphthenic | kV40 = 8 $mm^2/s$ | T9 (Nynas, Stockholm, Sweden)/GADUS NH 8/40 |

-continued

| base oil | kinematic viscosity (40° C.) | example |
|---|---|---|
| | | (Shell, Den Haag, The Netherlands) |
| group I | kV40 = 114 $mm^2/s$ | SN 600 (Shamrock, Limassol, Cyprus) |
| group I | kV40 = 500 $mm^2/s$ | BRIGHTSTOCK 460 (Total Lubrifiants, LeHavre, France) |
| group II | kV40 = 102 $mm^2/s$ | CHEVRON NEUTRAL 600 R (Chevron, Gent, Belgium) |
| group II | kV40 = 3.5 $mm^2/s$ | Base Oil PL 35 (Fa. Petro Canada, Calgary/Canada) |

With regard to the sulfonate component, also Calcinate™ OTS (Chemtura Corp. Petroleum Additives, Middlebury, Conn., USA) can be used as an overbased Ca sulfonate. As a neutral Na sulfonate, for example, Petronate® H (Sonneborn, Amsterdam, The Netherlands) can be used.

Aside from benzotriazole, water-soluble benzene derivatives, e.g. Irgamet 42 (Ciba SpezialMtenchemie, Basel, Switzerland), or triethanolamine can be employed as inhibitor components within the claimed boundaries.

Table 6 provides further alternative suitable ester components:

| | | |
|---|---|---|
| fatty acid ester | FA ester saturated, TMP, branched | PRIOLUBE 1968 (Croda, Nettetal, DE) |
| fatty acid ester | FA ester saturated, TMP C8-10 | PRIOLUBE ™ 3970 (Croda, Nettetal, DE) |
| fatty acid ester | NPG diisostearate | PRIOLUBE ™ 1973 (Croda, Nettetal, DE) |
| fatty acid ester | TMPO | RADIALUBE 7364 (Oleon GmbH, Wiesbaden, DE) |
| fatty acid ester | triglyceride C8-C10 | RADIAMULS MCT 2106 (Oleon GmbH, Wiesbaden, DE) |
| fatty acid ester | HC, butyl ester | Alphanox 2015 (alpha Chemie, Freital, DE) |
| wool fat ester | wool fat ester (PE) | Ewasol EPS 24 (H. Erhard Wagner GmbH, Bremen, DE) |
| wool fat ester | wool fat ester | Ewasol LY10 (H. Erhard Wagner GmbH, Bremen, DE) |

Table 7 lists further alternative EP/AW components:

| | | |
|---|---|---|
| phosphorus carrier | oleyl alcohol ethoxylate phosphate | Rhodafac PA 35 (Rhodia Novecare, Courbevoie, France) |
| phosphorus carrier | dimethyl octadecenyl phosphonate | Duraphos 100 (Rhodia Novecare, Courbevoie, France) |
| phosphorus carrier | triaryl thiophosphate | Irgalube TPPT (Ciba Spezialitätenchemie, Basel, Switzerland) |
| sulfur carrier | sulfurized hydrocarbon | TPS ® 20 (Arkema Inc., King of Prussia, Pennsylvania, USA) |
| sulfur carrier | sulfur polymer from lard oil | Additin RC 8000 (Rhein-Chemie Additives, Mannheim, DE) |
| sulfur carrier | overbased Na thiophosphonate | Roscan 491 (PCAS, Longjumeau, France) |
| sulfur carrier | S ester | Additin RC 2415 (Rhein-Chemie Additives, Mannheim, DE) |
| sulfur carrier | S ester (oleic acid methylester) | Additin RC 2411 (Rhein-Chemie Additives, Mannheim, DE) |
| sulfur carrier | aminodialkyl dithiophosphate | Additin RC 3880 (Rhein-Chemie Additives, Mannheim, DE) |
| sulfur carrier | ethylhexyl Zn dithiophosphate | Additin RC 3080 (Rhein-Chemie Additives, Mannheim, DE) |

In addition to the preferred non-ionic surfactants, also anionic surfactants such as alkyl ether carboxylic acid, e.g. Akypo RCP 105 (Kao Chemicals Europe, Barcelona, Spain) or phosphate esters such as Rhodafac PA 35 (Rhodia Novecare, Courbevoie, France) can be used.

Also, pure oleic acid, dimer acid (e.g. Pripol 1022, (Croda, Nettetal, DE)) or behenic acid (Prifrac 2989 (Croda, Nettetal, DE)) are conceivable as carboxylic acids.

Alternative phenolic antioxidants are e.g. butylated hydroxytoluene or Irganox® L 107 (BASF, Ludwigshafen, DE).

Alternative waxes or thickeners for adjusting the viscosity/rheology of the composition can be selected from Table 8:

| | | |
|---|---|---|
| paraffinic waxes | solidification point 63° C. | Sasolwax 6072 Sasol, Hamburg, DE) |
| castor oil derivative | castor oil derivative | LUVOTIX R (Lehmann &Voss&Co. KG, Hamburg, DE) |
| castor oil derivative | hydrogenated castor oil derivative, micronized | Albothix 82-32 (Alberdingk Boley GmbH, Krefeld, DE) |
| fatty acids and derivatives | methyl 12-hydroxystearate | NORACID 1115 (Nordmann Rassmann GmbH, Hamburg, DE) |
| fatty acids and derivatives | octadecyl stearate, stearyl stearate | |
| fatty acid amide | refined oleic acid amides | Crodamide OR (Croda, Nettetal, DE) |
| block polymer | PS-PE/PB-PS (30% PS) type ABA | KRATON ® G1650 EU (Kraton Polymers, Frankfurt a.M., DE) |
| PMA | polymethacrylate in mineral oil | Viscoplex ® 1-360 (Evonik, Essen, DE) |
| PIB | polyisobutylene 1300 | |

The removal of the corrosion protection, washing and/or forming lubricants for metal sheets in the automotive body-in-white process has been performed up to now mostly by alkaline aqueous media at a cleaning temperature of 55° C. The lubricant composition according to the invention is capable of achieving the complete removal even for an unheated cleaner system. Due to the process conditions and the introduced energy by pumping it is to be expected that a temperature slightly above room temperature will be adjusted. The cleaning tests that are described in the following for four exemplary compositions according to the invention and a comparative composition of the prior art were performed at 25° C. in the laboratory.

For the release procedure of corrosion protection and forming oils applied in the steel mill and in the pressing plant, the VDA (German Association of the Automotive Industry) test sheet 230-213 (2008) is usually employed. The method "Examination of Removability (Washability)" described therein in Chapter 5.10 with the VDA model cleaner is considered conclusive for the results in practice.

In this test method, an oiled sample metal sheet is introduced into a predetermined test bath container with a content of 18 liters and predetermined volume flow of 17 liters/min. After lapse of a predetermined test time, the metal sheet is removed and rinsed for 30 with defined shearing movement in a fresh water tank.

Immediately after removal from the fresh water tank, wetting of the metal sheet is evaluated. A water film closed across the entire metal sheet corresponds to the complete removability of the lubricant.

For the tests described in the following, a cleaning temperature of 25° C.±1° C. and 3 min cleaning duration were adjusted and, in accordance with the prior art, the oil film thickness or weight applied on the respective test sheet was set to 1.3±0.2 g/m$^2$. As test sheets, precut test sheets (0.8×102×152 mm; DC 04, type R-46, steel dull matt finish) of the company Q-Panel, Saarbrücken, were employed without further pretreatment. The cleaner system comprised test cleaner VDA 230-213 salt structure (of the company Henkel, Heidelberg) and surfactant (also Henkel, Heidelberg). A temperature of 20±2° C. and 30 s rinsing duration were adjusted for the cold rinse bath.

The application of the lubricant compositions according to the invention and of the comparative composition was done by dipping the test sheets in a corresponding n-heptane solution of the respective composition. After complete evaporation of the solvent, the required film weight was obtained.

Table 9 shows a composition according to the invention according to variant V 1.

| Variant V1 Ca + Na overbased | |
|---|---|
| CHEVRON NEUTRAL OIL 220R | 14.2 |
| PIONIER 4529 | 52.2 |
| tall oil fatty acid FOR 2 | 0.5 |
| wax HR 64-66 | 3 |
| Emulsogen M, Rhodasurf CET 5 | 5 |
| Rhodasurf CET 2 | 2.5 |
| Arcot 626 F | |
| Lubrizol 5318 A | 1.5 |
| Calcinate OR | 3.5 |
| Irganox L 57 | 0.25 |
| Irganox L135 | 0.25 |
| BTA needles (benzotriazole) | 0.1 |
| Doverphos 253 | 2 |
| METALEST-EHP/RADIA 7780 (2-ethylhexyl palmitate) | 15 |
| Sum % | 100 |

Table 10 shows a composition according to the invention according to variant V 2:

| Variant V2 Ca + Na overbased + neutral | |
|---|---|
| CHEVRON NEUTRAL OIL 220R | 14.2 |
| PIONIER 4529 | 49.2 |
| tall oil fatty acid FOR 2 | 0.5 |
| wax HR 64-66 | 3 |
| Emulsogen M, Rhodasurf CET 5 | 5 |
| Rhodasurf CET 2 | 2.5 |
| Arcot 626 F | 3 |
| Lubrizol 5318 A | 1.5 |
| Calcinate OR | 3.5 |
| Irganox L 57 | 0.25 |
| Irganox L135 | 0.25 |
| BTA needles (benzotriazole) | 0.1 |
| Doverphos 253 | 2 |
| METALEST-EHP/RADIA 7780 (2-ethylhexyl palmitate) | 15 |
| Sum % | 100 |

Table 11 shows a composition according to the invention according to variant V 3:

| Variant V3 Na overbased | |
|---|---|
| CHEVRON NEUTRAL OIL 220R | 14.2 |
| PIONIER 4529 | 52.6 |
| tall oil fatty acid FOR 2 | 0.5 |
| wax HR 64-66 | 3 |
| Emulsogen M, Rhodasurf CET 5 | 5 |
| Rhodasurf CET 2 | 2.5 |
| Arcot 626 F | |
| Lubrizol 5318 A | 4.6 |
| Calcinate OR | |
| Irganox L 57 | 0.25 |
| Irganox L135 | 0.25 |
| BTA needles (benzotriazole) | 0.1 |
| Doverphos 253 | 2 |
| METALEST-EHP/RADIA 7780 (2-ethylhexyl palmitate) | 15 |
| Sum % | 100 |

Table 12 shows a composition according to the invention according to variant V 4:

| Variant V4 Ca overbased | |
|---|---|
| CHEVRON NEUTRAL OIL 220R | 14.2 |
| PIONIER 4529 | 52 |
| tall oil fatty acid FOR 2 | 0.5 |
| wax HR 64-66 | 3 |
| Emulsogen M, Rhodasurf CET 5 | 5 |
| Rhodasurf CET 2 | 2.5 |
| Arcot 626 F | |
| Lubrizol 5318 A | |
| Calcinate OR | 5.2 |
| Irganox L 57 | 0.25 |
| Irganox L135 | 0.25 |
| BTA needles (benzotriazole) | 0.1 |
| Doverphos 253 | 2 |
| METALEST-EHP/RADIA 7780 (2-ethylhexyl palmitate) | 15 |
| Sum % | 100 |

As a comparative composition according to the prior art, Anticorit PL 3802 39 S of the company Fuchs Schmierstoffe GmbH, Mannheim, Germany, was selected. The product Anticorit PL 3802-39 S used for comparison represents the current art of corrosion protection oils with forming properties (the so-called pre-lubes). It has been widely used since 1996 in the steel industry, in particular for automotive steel for the body in white. This comparative composition of the prior art is characterized by easy removability in accordance with current standards.

FIGS. 1, 2, 3, and 4 show respectively photographic representations, after completed cleaning procedure as described above immediately after removal from the freshwater rinsing tank, of the test sheets which had been coated, in accordance with the numbering, with the exemplary lubricant compositions according to the present invention according to variants 1, 2, 3, and 4. All four show a closed water film across the entire metal sheet and thus complete wetting of the metal sheet which means a complete removal of the lubricant. Such a good washability at the present cold temperature range could not be realized with the lubricants of the prior art up to now.

Figure 5:
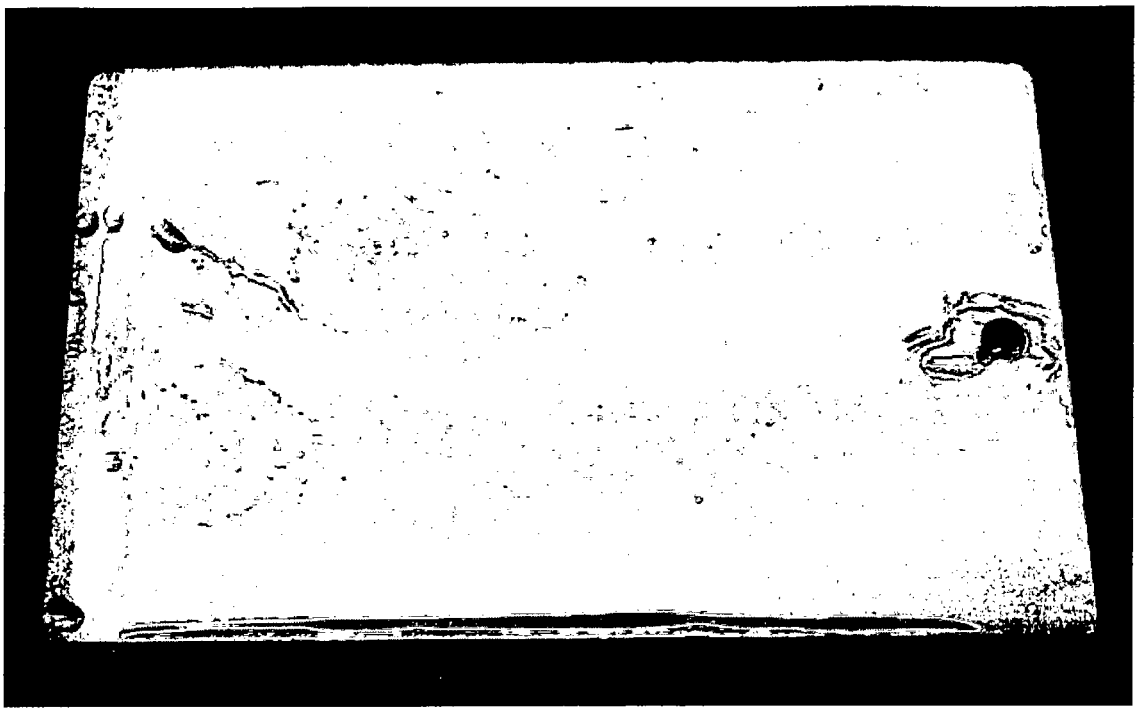
FIG. 5 a photographic representation of a test sheet that has been coated with a lubricant composition of the prior art, after completion of cleaning at 25° C.

For example, it can be seen clearly in the photographic representation of FIG. 5 that on the metal sheet, which had been coated with the comparative composition and subjected to the same procedure as the test sheets with the lubricant compositions according to the invention, the water film is not closed but exhibits clearly unwetted regions and run-off effect as they are created in case of incomplete removal of the lubricant.

Figure 6:
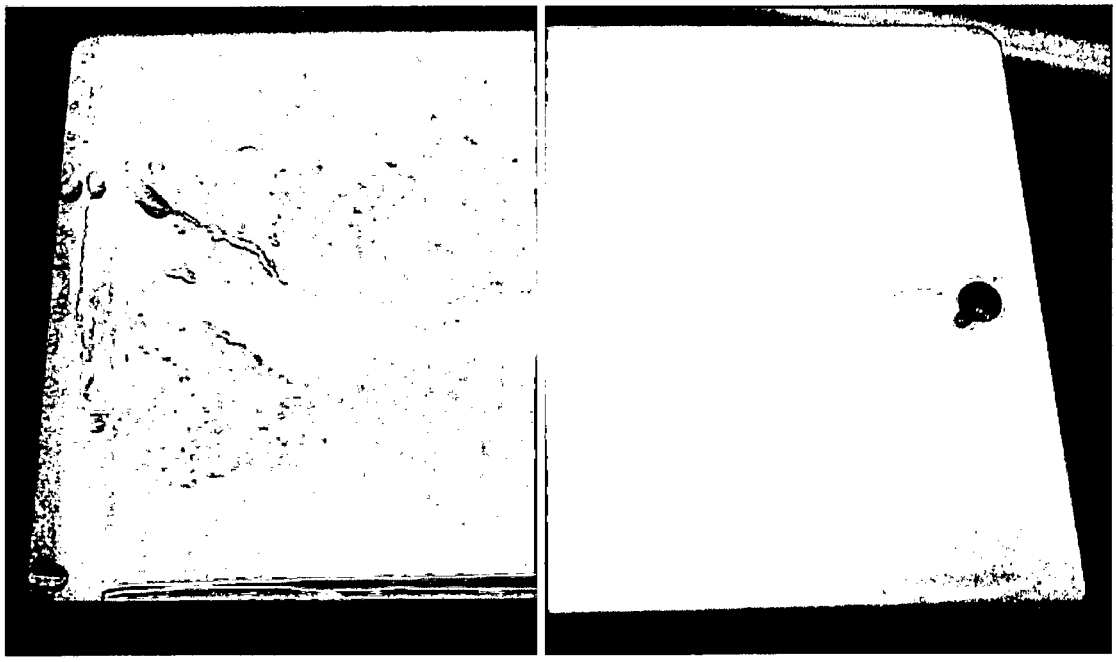
FIG. 6 a comparative illustration of the representations of the test sheet that has been coated with a lubricant composition of the prior art (left) and a test sheet that has been coated with a lubricant composition according to the invention (right).

The lubricant compositions according to the invention enable thus a significantly improved cold washability, which in particular can be seen clearly in the comparative illustration of the representations in FIG. 6 in which to the left the test sheet can be seen that had been coated with the comparative composition of the prior art and that after cleaning at 25° C. and freshwater rinsing shows clearly unwetted regions that are caused by unremoved lubricant residues while to the right the completely wetted test sheet is shown that had been coated with a composition according to the invention which has been removed completely by cleaning at 25° C. Therefore, the compositions according to the invention provide a significant improvement with regard to the energy expenditure required for cleaning. As the case may be, heating of the cleaner bath can even be advantageously completely omitted, depending on the environmental conditions.

The invention claimed is:

1. A lubricant composition that can be washed off cold for application on a metal strip as a corrosion protection, washing and/or forming lubricant, the lubricant composition comprising:

50 wt % to 90 wt % base fluid, relative to the total weight of the lubricant composition, wherein the base fluid is a mixture of at least two base oils differing in their kinematic viscosity at 40° C., wherein the at least two base oils are selected from group I base oils and group II base oils with a kinematic viscosity at 40° C. of 3 $mm^2/s$ to 700 $mm^2/s$, wherein group III base oils and group IV base oils are not excluded;

3 wt % to 15 wt % sulfonate-based corrosion inhibitor, relative to the total weight of the lubricant composition;

1 wt % to 20 wt % ester component, relative to the total weight of the lubricant composition;

0.5 wt % to 3 wt % phosphorus carrier component, relative to the total weight of the lubricant composition, or 1 wt % to 10 wt % sulfur carrier component, relative to the total weight of the lubricant composition, as an extreme-pressure/anti-wear additive, wherein:

the phosphorus carrier component is selected from the group consisting of dialkyl hydrogenphosphite, wherein each alkyl residue of the dialkyl hydrogenphosphite is saturated or unsaturated and comprises 14 to 22 C atoms; oleyl alcohol ethoxylate phosphate; dimethyl octadecenyl phosphonate; and triaryl thiophosphate; and the sulfur carrier component is selected from the group consisting of sulfurized hydrocarbon, sulfur-polymer from lard oil, overbased Na thiophosphonate, S ester, S ester of oleic acid methylester, aminodialkyl dithiophosphate, and ethylhexyl Zn dithiophosphate;

1 wt % to 15 wt % emulsifier, relative to the total weight of the lubricant composition, wherein the emulsifier is selected from non-ionic surfactants, anionic surfactants, or a mixture of non-ionic surfactants and/or anionic surfactants;

0.05 wt % to 1 wt % carboxylic acid component, relative to the total weight of the lubricant composition, wherein the carboxylic acid component is selected from the group consisting of carboxylic acids with 16 to 22 C atoms; dimer acids that are dicarboxylic acids produced by dimerization of unsaturated fatty acids of tall oil; and mixtures thereof;

0.05 wt % to 1 wt % antioxidant, relative to the total weight of the lubricant composition, wherein the antioxidant is selected from the group consisting of aminic antioxidant; phenolic antioxidant; and a mixture of aminic antioxidant and phenolic antioxidant;

0.5 wt % to 5 wt % wax and/or thickener component, relative to the total weight of the lubricant composition, wherein the wax and/or the thickener component is selected from the group consisting of paraffinic waxes; castor oil derivatives; fatty acid derivatives that are fatty acid esters or fatty acid amides of saturated and unsaturated C16-20 fatty acids; and polymeric thickeners.

2. The lubricant composition according to claim 1, comprising 55 wt % to 80 wt % of the base fluid relative to the total weight of the lubricant composition, wherein the kinematic viscosity at 40° C. of the lubricant composition is adjustable in a range of 5 $mm^2/s$ to 300 $mm^2/s$ by selection of the at least two base oils, wherein the kinematic viscosity at 40° C. is adjusted in a range of 5 $mm^2/s$ to 25 $mm^2/s$ for washing lubricants; in a range of 20 $mm^2/s$ to 120 $mm^2/s$ for rolling mill-applied corrosion lubricants or pre-lubes; and in a range of 60 $mm^2/s$ to 300 $mm^2/s$ for forming lubricants.

3. The lubricant composition according to claim 1, wherein, for a corrosion protection lubricant, the at least two base oils include a first base oil with the kinematic viscosity at 40° C. of 700 $mm^2/s$ and a second base oil with the kinematic viscosity at ° C. of 40 $mm^2/s$, wherein a weight ratio of the first base oil to the second base oil in the base fluid amounts to 3:1 to 4:1 and the kinematic viscosity at 40° C. amounts to 100±10 $mm^2/s$.

4. The lubricant composition according to claim 1, wherein the sulfonate-based corrosion inhibitor is selected from the group consisting of overbased and neutral Ca sulfonates; overbased and neutral Na sulfonates; and mixtures thereof.

5. The lubricant composition according to claim 4, wherein the lubricant composition comprises: 0.5 wt % to 5 wt % of the overbased Na sulfonate, and/or 2 wt % to 10 wt % of the overbased Ca sulfonate, and further comprises optionally 1 wt % to 5 wt % of the neutral Ca sulfonate, and/or 1 wt % to 5 wt % of the neutral Na sulfonate, provided that a sum of weight proportions of the sulfonate-based corrosion inhibitors makes up 3 wt % to 15 wt % of the total weight of the lubricant composition.

6. The lubricant composition according to claim 4, wherein the lubricant composition comprises 1 wt % to 5 wt % of the overbased Na sulfonate and further comprises 3 wt % to 5 wt % of the overbased Ca sulfonate, relative to the total weight of the lubricant composition, respectively.

7. The lubricant composition according to claim 4, wherein the lubricant composition comprises: 1 wt % to 5 wt % of the overbased Na sulfonate, 3 wt % to 5 wt % of the overbased Ca sultanate, and 1 wt % to 5 wt % of the neutral Ca sulfonate, relative to the total weight of the lubricant composition, respectively.

8. The lubricant composition according to claim 4, wherein the lubricant composition comprises 3 wt % to 6 wt % of the overbased Na sulfonate relative to the total weight of the lubricant composition.

9. The lubricant composition according to claim 4, wherein the lubricant composition comprises 3 wt % to 10 wt % of the overbased Ca sulfonate relative to the total weight of the lubricant composition.

10. The lubricant composition according to claim 1, wherein the lubricant composition further comprises 0.05 wt % to 1.7 wt % of at least one further inhibitor component, relative to the total weight of the lubricant composition, wherein the at least one further inhibitor component is selected from the group consisting of triazoles and amines.

11. The lubricant composition according to claim 10, wherein the at least one further inhibitor component comprises 0.05 wt % to 0.2 wt % of the triazoles and/or 0.1 to 1.5 wt % of the amines.

12. The lubricant composition according to claim 10, wherein the at least one further inhibitor component comprises 0.1 wt % of the triazole that is benzotriazole or a benzotriazole derivative and/or 0.1 wt % to 1.5 wt % of the amine that is trialkanolamines.

13. The lubricant composition according to claim 1, wherein the ester component comprises 10 wt % to 20 wt % fatty acid esters or 1 wt % to 5 wt % wool fat esters, relative to the total weight of the lubricant composition, respectively.

14. The lubricant composition according to claim 1, wherein the lubricant composition comprises 2 wt % of the phosphorus carrier component, relative to the total weight of the lubricant composition, as the extreme-pressure/anti-wear additive, wherein the phosphorus carrier component is dialkyl hydrogenphosphite, wherein each alkyl residue of the dialkyl hydrogenphosphite comprises 14 to 22 C atoms.

15. The lubricant composition according to claim 1, wherein:

the non-ionic surfactants are selected from fatty alcohol alkoxylates and mixtures thereof, wherein the fatty alcohol alkoxylates are based on fatty alcohols with 16 to 18 C atoms and comprise a degree of ethoxylation of 2 to 5 moles, and the anionic surfactants are selected from the group consisting of alkylether carboxylic acids and phosphoric acid esters, wherein a proportion of each one of the non-ionic surfactants and the anionic surfactants, alone or in the mixture, amounts to 1 wt % to 5 wt %, respectively, relative to the total weight of the lubricant composition, provided that a total amount of the emulsifier does not surpass 15 wt % relative to the total weight of the lubricant composition.

16. The lubricant composition according to claim 15, wherein the alkylether carboxylic acids are $C_{14-22}$ fatty alcohol polyglycol ether carboxylic acids and wherein the phosphoric acid esters are alkoxylated fatty alcohol phosphate esters of fatty alcohols with 16 to 18 C atoms and a degree of ethoxylation of 5 moles.

17. The lubricant composition according to claim 15, wherein the lubricant composition comprises 7.5 wt % of the fatty alcohol alkoxylates as the emulsifier relative to the total weight of the lubricant composition.

18. The lubricant composition according to claim 17, wherein the fatty alcohol alkoxylate is comprised of 5 wt % $C_{16-18}$ fatty alcohol with a degree of ethoxylation of 5 moles and 2.5 wt % $C_{16-18}$ fatty alcohol with a degree of ethoxylation of 2 moles.

19. The lubricant composition according to claim 1, wherein the carboxylic acid with 16 to 22 C atoms is tall oil fatty acid, oleic acid, or behenic acid.

20. The lubricant composition according to claim 19, wherein the lubricant composition comprises 0.5 wt % of the tall oil fatty acid relative to the total weight of the lubricant composition.

21. The lubricant composition according to claim 1, wherein the aminic antioxidant is a reaction product of N-phenyl benzenamine with 2,4,4-trimethyl pentene, wherein the phenolic antioxidant is selected from octyl-3, 5-di-tert-butyl-4- hydroxyhydrocinnamate and/or octadecyl-3-(3,5-di-tert-butyl-4-hydroxyphenyl)propionate, wherein the lubricant composition comprises 0.25 wt % of the aminic antioxidant and 0.25 wt % of the phenolic antioxidant, relative to the total weight of the lubricant composition, respectively.

22. The lubricant composition according to claim 1, wherein the wax and/or thickener component is selected from paraffinic waxes and/or castor oil derivatives in the form of thixotropic thickeners based on hydrogenated castor oil.

23. The lubricant composition according to claim 22, wherein the lubricant composition comprise 3 wt % of the paraffinic wax with a solidification point at 64° C. to 66° C.

24. A dry lubricant composition that can be washed off cold for application on a metal strip as corrosion protection lubricant or pre-lube, the lubricant composition comprising:

wt % to 90 wt % wax component, relative to the total weight of the lubricant composition, wherein the wax component has a melting range of 35° C. to 75° C. and is selected from the group consisting of polyalkylene glycol, polyalkylene glycol ester, ester, ester ethoxylate, a carboxylic acid ethoxylate, ether carboxylic acid and alkaline and alkaline earth soaps thereof, glycerin fatty acid ester, polyol esters and ethoxylates thereof, sorbitol esters and ethoxylates thereof, alcohols and ethoxylates thereof, fatty alcohols and ethoxylates thereof, paraffinic waxes, castor oil derivatives, fatty acid derivatives selected from fatty acid esters or fatty acid amides of saturated and unsaturated C 16-20 fatty acids;

3 wt % to 15 wt % sulfonate-based corrosion inhibitor, relative to the total weight of the lubricant composition;

0.05 wt % to 1.7 wt % of at least one further inhibitor component, relative to the total weight of the lubricant composition, wherein the at least one further inhibitor component selected from the group consisting of triazoles, benzotriazole, benzotriazole derivatives, and amines;

0.5 wt % to 3 wt % phosphorus carrier component, relative to the total weight of the lubricant composition, or 1 to 10 wt % sulfur carrier component, relative to the total weight of the lubricant composition, as an extreme-pressure/anti-wear additive, wherein:

the phosphorus carrier component is selected from the group consisting of dialkyl hydrogenphosphite, wherein each alkyl residue of the dialkyl hydrogenphosphite is saturated or unsaturated and comprises 14 to 22 C atoms; oleyl alcohol ethoxylate phosphate; dimethyl octadecenyl phosphonate; and triaryl thiophosphate; and the sulfur carrier component is selected from the group consisting of sulfurized hydrocarbon, sulfur-polymer from lard oil, overbased Na thiophosphonate, S ester, S ester of oleic acid methylester, aminodialkyl dithiophosphate, ethylhexyl Zn dithiophosphate;

0 wt % to 15 wt % emulsifier, relative to the total weight of the lubricant composition, the emulsifier selected from non-ionic surfactants or anionic surfactants or a mixture of non-ionic surfactants and/or anionic surfactants, wherein the emulsifier can be omitted when the wax component comprises a sorbitan ester ethoxylate selected from sorbitan tristearate ethoxylate and sorbitan monostearate ethoxylate;

0.05 wt % to 1 wt % carboxylic acid component, relative to the total weight of the lubricant composition, the carboxylic acid component selected from the group consisting of carboxylic acids with 16 to 22 C atoms; dimer acids that are dicarboxylic acids produced by dimerization of unsaturated fatty acids from tall oil; or mixtures thereof;

0.05 wt % to 1 wt % antioxidant, relative to the total weight of the lubricant composition, wherein the antioxidant is selected from the group consisting of aminic antioxidant; phenolic antioxidant; and a mixture of aminic antioxidant and phenolic antioxidant;

wherein the lubricant composition, depending on the proportion of the wax component, comprises a base fluid as a supplement to a total of 100 wt % of the lubricant composition, wherein the base fluid is a mixture of at least two base oils differing in their kinematic viscosity at 40° C., wherein the at least two base oils are selected from group I base oils and group II base oils with a kinematic viscosity at 40° C. of 3 $mm^2/s$ to 700 $mm^2/s$, wherein group III base oils and group IV base oils are not excluded.

25. A method of using a lubricant composition according to claim 1 on a metal strip as corrosion protection, washing and/or forming lubricant, the method comprising: applying the lubricant composition according to claim 1 to the metal strip to form a film on the metal strip; washing off cold at a temperature below 50° C. the lubricant composition from the metal strip with an alkaline aqueous cleaner.

26. The method according to claim 25, comprising adjusting a surfactant concentration of the alkaline aqueous cleaner to a content of the emulsifier in the lubricant composition by refurbishing a surfactant component of the aqueous alkaline cleaner in a reduced quantity during washing off of the metal strip according to a quantity of the emulsifier of the lubricant composition introduced into the aqueous alkaline cleaner.

27. A method of using a lubricant composition according to claim 24 on a metal strip as corrosion protection, washing and/or forming lubricant, the method comprising: applying the lubricant composition according to claim 24 to the metal strip to form a film on the metal strip; washing off cold at a temperature below 50° C. the lubricant composition from the metal strip with an alkaline aqueous cleaner.

28. The method according to claim 27, comprising adjusting a surfactant concentration of the alkaline aqueous cleaner to a content of the emulsifier of the lubricant composition by refurbishing a surfactant component of the aqueous alkaline cleaner in a reduced quantity during washing off of the metal strip according to a quantity of the emulsifier of the lubricant composition introduced into the aqueous alkaline cleaner.

* * * * *